US005791524A

United States Patent [19]

Demarest

[11] Patent Number: 5,791,524

[45] Date of Patent: Aug. 11, 1998

[54] TOTAL RELEASE ACTUATOR FOR AN AEROSOL CAN

[75] Inventor: Scott W. Demarest, Caledonia, Wis.

[73] Assignee: S. C. Johnson & Son, Inc., Racine, Wis.

[21] Appl. No.: 854,313

[22] Filed: May 12, 1997

[51] Int. Cl.[6] ..... B65D 83/14

[52] U.S. Cl. ..... 222/153.06; 222/153.12; 222/402.13; 222/402.14

[58] Field of Search ..... 222/153.06, 153.12, 222/402.13, 402.14

[56] References Cited

U.S. PATENT DOCUMENTS

| | | | |
|---|---|---|---|
| D. 323,117 | 1/1992 | Demarest . | |
| 2,910,391 | 10/1959 | Toulmin, Jr. . | |
| 3,137,414 | 6/1964 | Steinkamp . | |
| 3,185,350 | 5/1965 | Abplanalp et al. . | |
| 3,305,144 | 2/1967 | Beres et al. . | |
| 3,519,173 | 7/1970 | Sagarin . | |
| 3,729,120 | 4/1973 | Sette et al. . | |
| 3,804,302 | 4/1974 | Yamada et al. . | |
| 3,844,448 | 10/1974 | Sette . | |
| 3,920,162 | 11/1975 | Kimura . | |
| 4,186,853 | 2/1980 | White . | |
| 4,260,080 | 4/1981 | Gailitis . | |
| 4,277,004 | 7/1981 | Barlics . | |
| 4,381,065 | 4/1983 | Hayes . | |
| 4,428,509 | 1/1984 | Emerson et al. . | |
| 4,823,986 | 4/1989 | Pearce, III . | |
| 5,503,303 | 4/1996 | LaWare et al. . | |
| 5,649,645 | 7/1997 | Demarest et al. | 222/402.13 |

*Primary Examiner*—Philippe Derakshani

[57] ABSTRACT

A total release actuator for use with an aerosol can having a chime, a dome, and a valve having a valve stem. The actuator has an actuator body with a lower margin defining a skirt rim that attaches to the aerosol can and a central well having a generally horizontal well floor that has a trigger port extending therethrough. The actuator has a trigger that is hingedly attached to the actuator body, preferably at its front end to the front end of the trigger port. The trigger swings downwardly when it is depressed. The trigger extends across the valve stem and includes a downwardly open stem socket that receives the valve stem. The stem socket communicates with a discharge nozzle. The trigger, when moved downwardly, activates the valve, releasing the contents of the can through the discharge nozzle via the stem socket. A latch is attached to preferably each side of the trigger port, extending laterally under the trigger. The latch is elastically deformable, allowing the trigger to pass as it is depressed downwardly and then springing back over the trigger to retain it in the depressed, valve-activating position, allowing can contents to discharge. By this procedure, a user can release the entire contents of the aerosol can without the user's having to continue to depress the trigger. A method is described of discharging the contents of an aerosol can by use of such an actuator.

24 Claims, 3 Drawing Sheets

TOTAL RELEASE ACTUATOR FOR AN AEROSOL CAN

BACKGROUND OF THE INVENTION

This invention relates to actuators for aerosol cans and, in particular, to actuators that, once activated, are locked in the actuating position, allowing the entire contents of the aerosol can to be released without further action by the user. Such total release actuators are commonly used in insecticide fogger products and with other products that are intended to be used as a single, large discharge rather than as a series of separate bursts.

The device shown in Emmerson et al., U.S. Pat. No. 4,428,509, is an example of such actuators. It is intended for use with a standard aerosol can having a valve cup with a valve cup rim and a center valve stem. The Emmerson et al. device snaps onto the valve cup rim. The device has a trigger hingedly mounted in an actuator body. The trigger is depressed by the user, activating the valve by pressure exerted downwardly against the valve stem. The body has a projecting latch that is presented toward that end of the trigger which is distant from the hinge. When the trigger is depressed, the latch snaps over a cooperating structure on the end of the trigger, locking the trigger in the down position.

Steinkamp, U.S. Pat. No. 3,137,414; Abplanalp et al., U.S. Pat. No. 3,185,350; and one embodiment shown in Barlics, U.S. Pat. No. 4,277,004 all employ a hinged trigger generally similar to that of Emmerson et al., but with different locking strategies. The actuators of these patents all attach to the valve cup rim.

Conventional valves for aerosol cans commonly are designed to be activated in one of two different ways. Either the valve stem is pushed directly down to activate it or it is tilted to the side. The actuators just discussed all are intended for use with valves of the type that require vertical push activation. LaWare et al., U.S. Pat. No. 5,503,303, is intended for use with a side-tilt valve. LaWare et al., U.S. Pat. No. 5,503,303 utilizes a sliding panel that engages a valve stem. The actuator is used by thrusting the panel horizontally, which motion moves the valve stem to the side, activating it. Detents in the cap interact with the structures on the moving panel to lock it into the on position. The LaWare et al. device attaches to the chime of the can. The chime is that joint formed between the body of the can and the generally dome-shaped structure that supports the valve cup.

The art includes a number of designs for locking actuators that employ a button-type structure that is depressed directly downwardly to actuate a vertical push-type valve, the button then being locked in the downward, activating position. See, for example, Yamada et al., U.S. Pat. No. 3,804,303; Sette, U.S. Pat. No. 3,844,448; White, U.S. Pat. No. 4,186,853; Barlics, U.S. Pat. No. 4,277,004; Sette et al., U.S. Pat. No. 3,729,120; and Sagarin, U.S. Pat. No. 3,519,173. Gailitis, U.S. Pat. No. 4,260,080, shows a device that is supported solely by the valve stem and is adapted for use with a tilt stem valve.

Most of these devices are mounted to the valve cup rim, and all of the devices listed that utilize a depressable trigger arm are so mounted. This can lead to difficulties illustrated by the Emmerson et al. device, as seen in FIGS. 5 and 6 of U.S. Pat. No. 4,428,509. The trigger arm or "actuator button" shown at 26 in those drawings, is, of necessity, shorter than the width of the valve cup. Consequently, when it is moved from the up position (shown in FIG. 5) to the down position (shown in FIG. 6) the valve stem socket moves through a considerable arc. As a result, the longitudinal axis of the socket swings considerably out of alignment with the longitudinal axis of the valve stem, increasing the opportunity for leakage at the interface between the now poorly aligned socket and valve stem. The depressable end of the trigger arm of Barlics shown in FIGS. 4–6 is extended beyond the circuit of the valve cup rim. However, the Barlics hinge remains within the valve cup rim, so that the distance from hinge to valve stem socket remains as short as that distance in Emmerson et al. with the same geometrically-imposed alignment difficulties.

The Emmerson et al. actuator trigger arm locks in the down position by the action of a single spur, shown at 52 in the Emmerson et al. figures, which extends from the body of the actuator to engage a ledge 54 on the actuator trigger. Breakage or other mechanical failure of the single spur 52 results in a non-operable total release actuator. Furthermore, if the entire Emmerson et al. actuator is flexed by being squeezed from side to side, the ledge 54 tends to be drawn away and out from under the spur 52 to release the button 26, interrupting the dispensing of the contents of the aerosol can.

The art still is in need of a reliable total release actuator having a stem socket that reliably engages the valve stem through the entire swing of the trigger arm and being less subject to failure by distortion of the actuator or by mechanical failure of single locking devices.

BRIEF SUMMARY OF THE INVENTION

The invention provides a total release actuator for use with an aerosol can having a chime, a dome, and a valve having a valve stem. The actuator has an actuator body having a peripheral skirt that extends downwardly, the lower margin of the peripheral skirt defining a skirt rim. The actuator is adapted to attach to the aerosol can, and preferably the skirt rim is adapted to attach to the aerosol can.

The actuator body has a central well having a generally horizontal well floor. The well floor has a trigger port extending therethrough, the trigger port having a front end, a back end, and opposed sides. The actuator has a longitudinally extended trigger having a front end, a back end, and sides. The trigger is attached at one of its front and back ends to the corresponding end of the trigger port by a hinge. The hinge allows the end of the trigger that is remote from the hinge to swing downwardly when the trigger is depressed, the trigger extending from the hinge across the valve stem when the actuator is in place on the aerosol can.

Preferably, the trigger is so attached at its front end to the front end of the trigger port. In this preferred arrangement, the hinge allows the trigger's back end to swing downwardly when the trigger is depressed.

The trigger extends across the valve stem when the actuator is in place on the aerosol can and includes a downwardly open stem socket that is adapted to receive the valve stem. The stem socket is in fluid communication with a discharge nozzle. The trigger, when moved downwardly, activates the valve by exerting pressure on the valve stem, releasing the contents of the can through the discharge nozzle via the stem socket.

The actuator further includes an elastically deformable latch attached to one of a side of the trigger port and a side of the trigger and adapted to engage the other of the side of the trigger port and the side of the trigger when the trigger is in a depressed, valve-activating position to retain the trigger in that position. Preferably, the latch is attached to one of the sides of the trigger port and extends laterally under the trigger. When so attached to the trigger port, the latch first flexes sidewardly, allowing the trigger to pass as it is depressed by a user downwardly beyond the latch to a valve-activating position. Then the latch springs back over the trigger to retain it in the valve-activating position, allowing can contents to discharge. By this means, a user can release the entire contents of the aerosol can without the user's having to continue to depress the trigger.

In a preferred embodiment, the total release actuator includes two latches, one extending from each of the opposed sides of the trigger port, to retain the trigger under and between the latches when a user has depressed the trigger downwardly beyond the latches to the valve-activating position.

In another preferred embodiment, the latch is located beneath the level of the well floor. In this embodiment, the trigger includes a push pad, on which a user can push to depress the trigger. The trigger further includes a downwardly extended drop side that has an upwardly presented lug. As the trigger is depressed to the valve-activating position, the lug moves beneath and then engages the latch, locking the trigger in the valve-activating position. The latch is located sufficiently far beneath the well floor that the trigger reaches its valve-activating position before the finger of a user, pressing on the push pad, makes contact with the latch.

Although the skirt rim can be attached to the valve cup rim of the can, it is preferred that the skirt rim be adapted to engage and, preferably, attach to the chime of the aerosol can, that the hinge be distal to the valve cup rim when the actuator is in place on the can, and that the trigger include a push pad remote from the hinge, with the stem socket being located between the hinge and the push pad.

In one aspect, the total release actuator of the invention includes a tear tab attached by attachment members to both the end of the trigger remote from the hinge and the corresponding end of the trigger port remote from the hinge. The tear tab and attachment members have a robustness and strength such that the tear tab stabilizes the trigger to reduce the chance of premature activation. However, when a user intentionally and forcibly moves the tear tab, the attachment members break, allowing the tear tab to be removed, leaving the trigger free to be depressed. Preferably the attachment members are shaped so as to break preferentially at a point remote from the tear tab. This causes the attachment members, when the tear tab is torn away, to break free from the trigger and the back end of the trigger port and remain attached to the tear tab.

In the most preferred embodiment of the invention, the peripheral skirt extends upwardly above the level of the well floor, and the central well has a well wall that extends upwardly from the margins of the well floor and is joined to the upper margin of the peripheral skirt to form a double-walled, hollow bracing structure. Preferably, the actuator includes, in combination, the bracing structure, well floor, and chime-engaging skirt rim disclosed, which coact to increase the resistance of the actuator body to lateral flexing. As a result, the reliability of the latch's retention of the trigger in the valve actuating position is improved.

The method of the invention for total release of the contents of an aerosol can includes the following steps, the aerosol can having a chime and a valve, the valve having a valve stem. First, a total release actuator, in one of the aspects or forms described above, is provided, attached to the aerosol can, and preferably to the chime of the can. Then the trigger is depressed by manual pressure until the latch engages the trigger to retain it in its valve-actuating position. Finally, the can's contents are allowed to discharge.

DETAILED DESCRIPTION OF THE INVENTION

Figure 1:
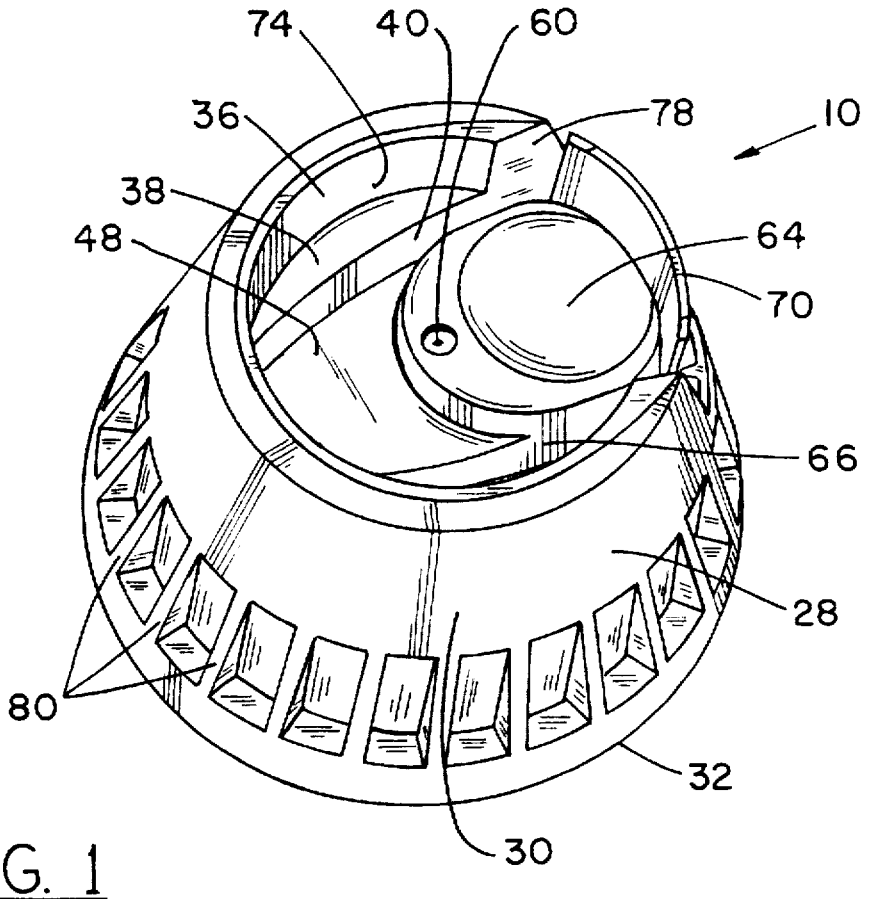
FIG. 1 is a front perspective view of the total release actuator of the invention, from above and to the right.

Turning now to the drawings, wherein like parts are indicated by like reference numbers, FIG. 1 shows the preferred embodiment of the total release actuator of the invention, shown generally at 10. The total release actuator 10 is adapted for use with a conventional aerosol can, such as that shown in phantom at 12 in FIG. 4. Such aerosol cans 12 include a cylindrical can wall 14 that is closed at its upper margin by a dome 16. The joint between the upper margin of the can wall 14 and the dome 16 is referred to as the can chime 18.

A valve cup 20 is located at the center of the dome 16 and is joined to the dome by a joint that is referred to as the valve cup rim 22. A valve 24 is located at the center of the valve cup 20. The valve 24 has an upwardly extending valve stem 26, through which the contents of the can may be expelled. Valves 24 typically are either vertically actuated valves, which are opened by moving the valve stem 26 directly downwardly, or side-tilt valves. A side-tilt valve is actuated by tipping the valve stem laterally.

The total release actuator 10 has an actuator body 28 adapted to attach to the aerosol can 12. The actuator body 28 has a peripheral skirt 30. The lower margin of the peripheral skirt 30 defines a skirt rim 32. The skirt rim 32 is adapted to fit over and engage the chime 18. The skirt rim 32 shall be understood to "engage" the chime 18 if it contacts the chime in such a manner as to be laterally braced against it. Preferably, the skirt rim 32 actually attaches to the chime 18 by means of undercuts 34 that extend inwardly from the interior surface of the skirt rim. In assembly, the actuator body 28 is forced downwardly onto the chime 18, the undercuts 34 slipping over the chime to snap under it, fastening the actuator body to the chime. The advantage of this point of engagement or attachment will be discussed below.

The actuator body 28 also has a central well 36. The central well 36 preferably has a generally horizontal well floor 38, best shown in FIGS. 1 and 2. The central well 36 has a trigger port 40, preferably located in and extending through the well floor 38. The trigger port 40 has a front end 42, a back end 44, and opposed sides 46.

The total release actuator 10 of the invention includes a longitudinally extended trigger 48. The trigger 48 has a front end 50, a back end 52, and sides 54. The trigger 48 is attached at one of its front and back ends 50,52 to the corresponding front or back end 42,44 of the trigger port 40. This attachment is by means of a hinge 56, which most conveniently is a living hinge that is unitarily molded with the remaining parts of the total release actuator 10. Preferably, the trigger 48 is attached at its front end 50 to the front end 42 of the trigger port 40, as is shown in the figures, to allow the trigger's back end 52 to swing downwardly when the trigger is depressed. In any event, the hinge 56 allows the end of the trigger 48 that is remote from the hinge to swing downwardly when the trigger is depressed. The trigger 48 extends from the hinge 56 across the valve stem 26 when the actuator is in place on the aerosol can 10. This relationship is best shown in FIG. 4.

Figure 3:
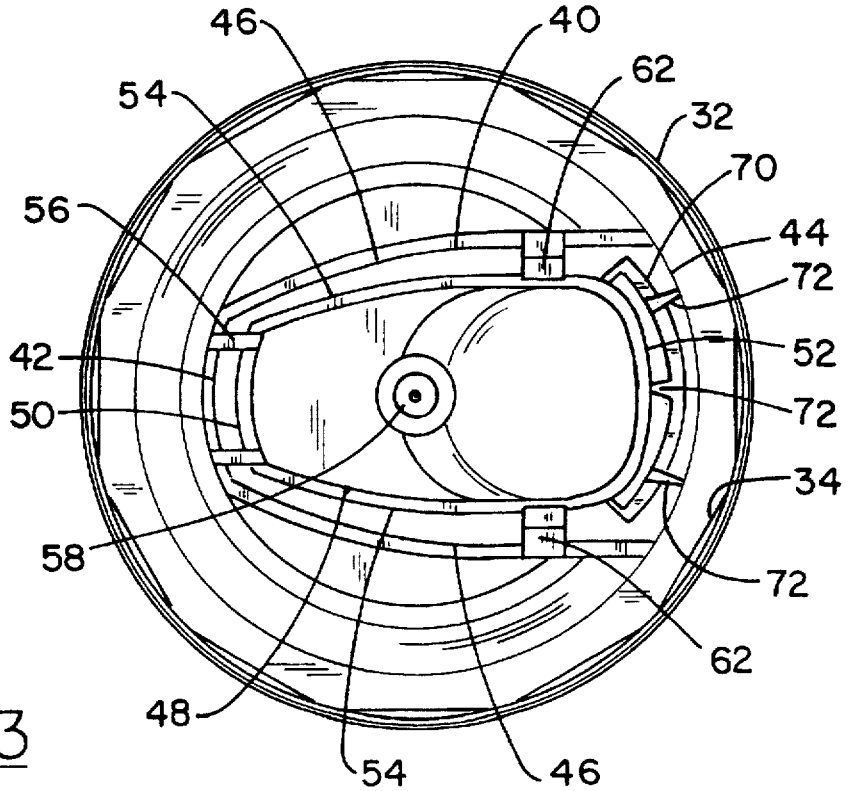
FIG. 3 is a bottom plan view of the actuator of FIG. 1.
Figure 4:
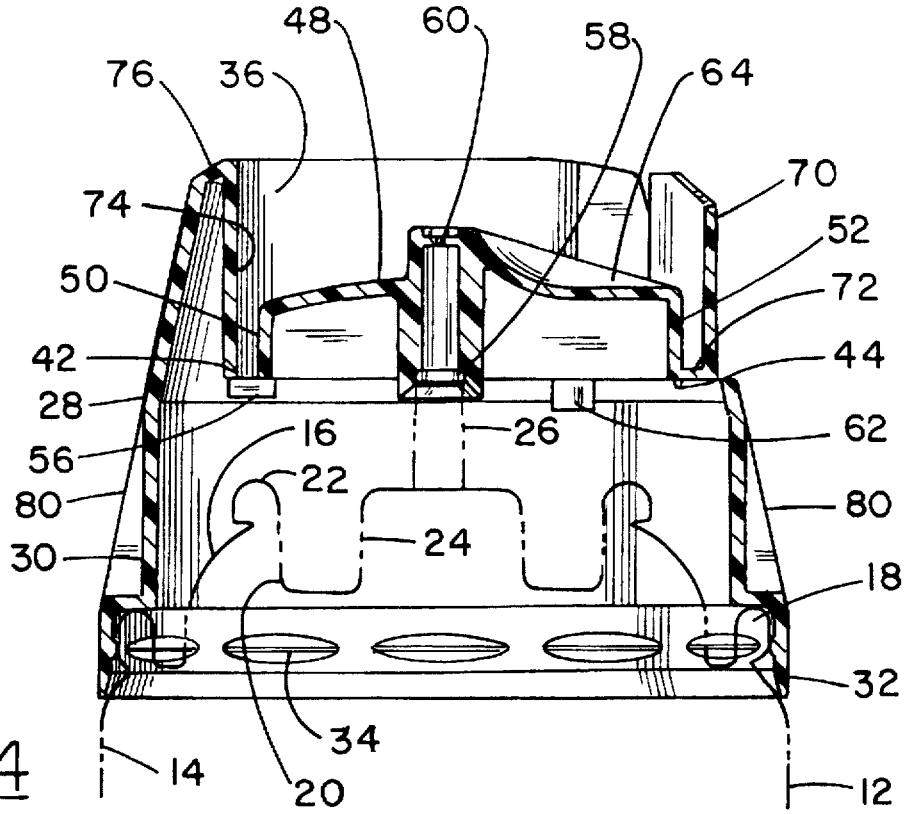
FIG. 4 is a cross-sectional view taken along section lines 4—4 of FIG. 2.

The trigger 48 further includes a downwardly open stem socket 58, shown in FIGS. 3 and 4. The stem socket 58 is adapted to receive the valve stem 26 and is in fluid communication with a discharge nozzle 60. The trigger 48, when moved downwardly, activates the valve 24 by exerting pressure on the valve stem 26 to release the contents of the can 10 through the discharge nozzle 60 via the stem socket 58.

The total release actuator 10 of the invention further includes a latch 62 that preferably is elastically deformable. The latch 62 is attached to one of a side 46 of the trigger port 40 and a side 54 of the trigger 48. The latch 62 is adapted to engage the other of the side 46 of the trigger port 40 and the side 54 of the trigger 48 when the trigger is in a depressed, valve-activating position to retain the trigger in that position. When in the valve-activating position, the trigger 48 moves the valve stem 26 sufficiently to activate the valve 24.

Figure 5:
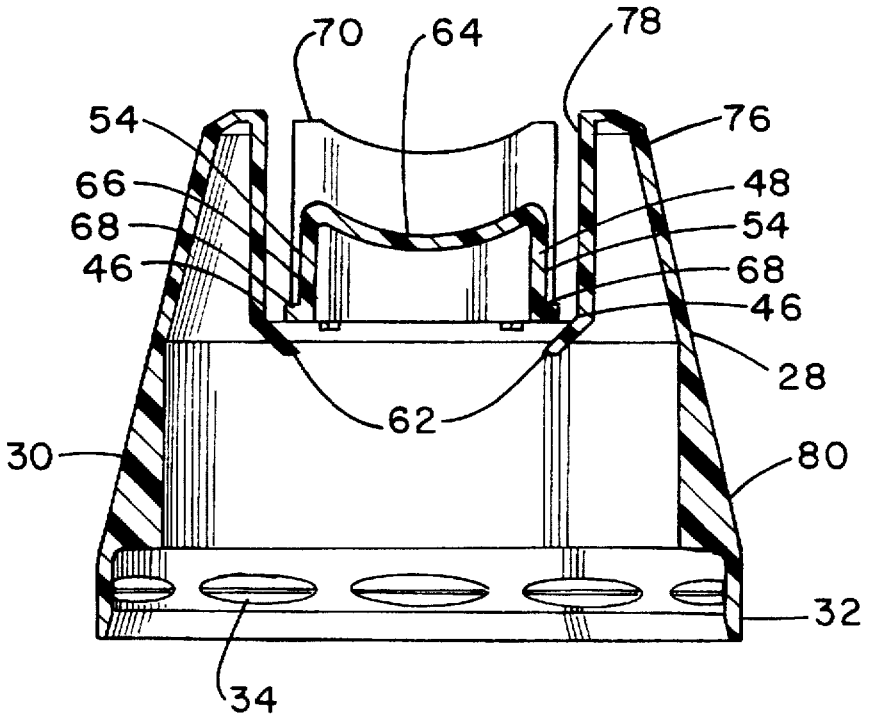
FIG. 5 is a cross-sectional view taken along section lines 5—5 of FIG. 2

It is preferred that the latch 62 is attached to a side 46 of the trigger port 40 and that, before the total release actuator 10 is activated, the latch 62 extends laterally under the trigger 48, as is best seen in FIGS. 3 and 5. In this embodiment, when the trigger 48 is depressed by a user, the latch 62 first flexes sidewardly, allowing the trigger 48 to pass downwardly beyond the latch to the valve-activating position. When the trigger 48 has reached the valve-activating position, the latch 62 then springs back over the trigger to retain the trigger in the valve-activating position.

Preferably, the total-release actuator 10 includes two latches 62. In the preferred embodiment shown in the Figures, one latch 62 extends from each of the opposed sides 46 of the trigger port 40, although location of the latches on opposed sides 54 of the trigger 48 is also possible. By this means, the two latches 62 retain the trigger 48 under and between the latches when a user has depressed the trigger downwardly between them to the valve-activating position. This arrangement, in combination with other features of the total-release actuator 10 discussed below, leads to a more reliable and trouble-free retention of the trigger 48 when the actuator is used.

Preferably the latch 62 is located beneath the level of the well floor 38. Preferably the trigger 48 includes a push pad 64 on which a user can push to depress the trigger. The push pad 64 may be a surface specially shaped to comfortably receive the user's finger without slipping off the trigger 48, as is the push pad shown in the Figures. However, any surface made available for a user to push on to move the trigger 48 is within the breadth and scope of the invention. The trigger 48 preferably also includes a downwardly extended drop side 66. The drop side 66 has an upwardly presented lug 68, the drop side and lug being best shown in FIG. 5. The lug 68 moves beneath and then engages the latch 62 when the trigger 48 is depressed to the valve activating position. The latch 62 is located sufficiently far beneath the well floor 38 that the trigger 48 reaches its valve-activating position before the finger of a user, pressing on the push pad 64 has the opportunity to contact the latch.

Preferably, the hinge 56 is located at a point not less distal to the valve stem 26 than the valve cup rim 22, when the actuator is in place on the can 12. Also preferably, the push pad 64 is located at a point remote from the hinge 56, and the stem socket 58 is located between the hinge and the push pad. This arrangement is relatively difficult to achieve with a valve cup rim 22 attachment of the actuator 10, which is one of the reasons why attachment at the chime 18 is preferred. That hinge location makes possible a trigger 48 of extended length when compared to a trigger hinged at a point within the valve cup rim 22, providing a more advantageous lever arm length.

One advantage of the preferred hinge location is that it makes it easier for a user to activate the valve 24 simply because of the mechanical advantage of the longer lever arm. But beyond that, the arrangement allows the stem socket 58 to be further from the hinge 56 than would be the case if the hinge had to be within the circuit of the valve cup rim 22. Consequently, the stem socket 58 can be moved downwardly far enough to activate the valve 24 without the stem socket's swinging as far out of axial alignment with the valve stem 26 as would be the case if the hinge had to be located within the valve cup rim 22. This allows for a more reliable engagement of the valve stem 26 within the stem socket 58, with less leaking and a reduced malfunction rate.

Preferably the actuator 10 includes a tear tab 70 that is unitarily molded with the trigger 48 and the actuator body 28. The tear tab 70 is attached by attachment members 72 to both the end of the trigger 48 that is remote from the hinge 56 and the end of the trigger port 40 remote from the hinge. Thus, when the hinge 56 is located at the front end 42 of the trigger port 40, the tear tab 70 is located at the back end 44 of the trigger port.

Figure 2:
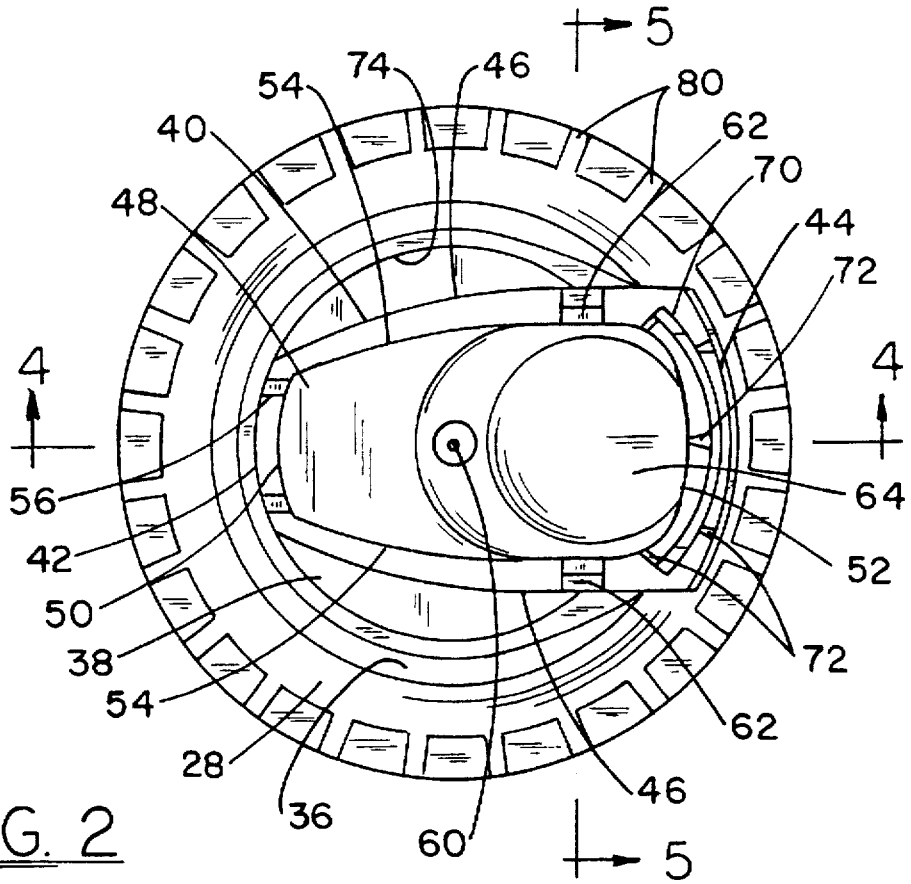
FIG. 2 is a top plan view of the actuator of FIG. 1.

The tear tab 70 and attachment members 72 are of a robustness and strength such that the tear tab stabilizes the trigger 48 while the tear tab is in place, reducing the chance of premature activation. However, when a user intentionally and forcibly moves the tear tab 70, the attachment members 72 break, allowing the tear tab to be removed and leaving the trigger 48 free to be depressed. The tear tab 72 and attachment members 72 are best shown in FIGS. 2–4.

Preferably the attachment members 72 are shaped so as to break preferentially at a point remote from the tear tab 70 and immediately adjacent to the remaining structure to which they are attached, be it the trigger 48 or the adjacent surface of the trigger port 40. This arrangement causes the attachment members 72, when the tear tab 70 is torn away, to break free from the trigger 48 and adjacent surface of the trigger port 40 and remain attached to the tear tab. This arrangement leaves the trigger 48 and trigger port 40 free of any remnant of an attachment member 72 that might otherwise be unsightly or uncomfortable to the finger.

Preferably, the peripheral skirt 30 of the actuator 10 extends upwardly beyond the level of the well floor 38, and a well wall 74 extends upwardly from the outer margins of the well floor. The well wall 74 is best illustrated in FIGS. 1, 2, and 4. The well wall 74 is joined to the upper margin of the peripheral skirt 30 to form a double-walled, hollow bracing structure 76, best illustrated in FIG. 4. The bracing structure 76 extends peripherally around the central well 36, preferably for at least half and more preferably for at least ¾ of its circumference. Preferably a finger gap 78 is left as an opening in the bracing structure 76 to allow a user easy access to the push pad 64. The tear tab 70 may be designed to substantially fill the finger gap 78, further reducing the likelihood of accidental premature activation prior to removal of the tear tab.

The bracing structure 76, well floor 78, and chime-engaging skirt rim 32 all coact to achieve a rigidity with respect to lateral compression that, taken together with the side location of the latches 62, is important to the successful operation of the actuator 10. An end-mounted latching arrangement, such as that seen in Emerson et al., U.S. Pat. No. 4,428,509, has important disadvantages. Because there is only one latch, any failure of that latch causes the trigger to be released from its actuating position and the actuator to malfunction. Simply having two latches 62 provides a backup.

However, placement of the latches is also vital. End placement, such as in Emerson et al., so locates the latch that distortion of the actuator by a laterally-applied compressive force tends to cause the latch to withdraw away from the trigger, potentially releasing it. If this distortion occurs in shipping or in manufacture (as can occur, solely as an example, if the actuator 10 is mounted on an under or over-sized can) an entirely non-functioning actuator may result. In contrast, side-to-side lateral distortion of the complete release actuator 10 of the invention moves the latches 62 inwardly, toward the trigger 48 rather than away from it. The trigger 48 is never caused to malfunction. Utilizing a pair of latches 62, as is preferred, even more reliably ensures that at least one latch will remain in position to lock the trigger 48 in its actuating position, once the trigger has been depressed, in that any movement of the trigger away from one latch automatically moves it toward the other latch. Further more, locating the latches 62 at the sides of the trigger 48 inevitably places them more centrally within the actuator 10. Consequently, the effects of peripheral distortion of the actuator are reduced, by simple geometry—a large distortion at the periphery still results in a reduced distortion at a radially interior position.

However, beyond these advantages of side placement of the latches 62, the preferred form of the total release actuator 10 includes the hollow-walled bracing structure 76 described above. This can be contrasted to the solid, otherwise visually corresponding structure of the Emerson et al. device. Not only is the bracing structure 76 itself fairly rigid because of its hollow-walled structure, but the well floor 38 provides further bracing. Consequently, the whole structure resists lateral deformation, whether lateral pressures are applied from side-to-side or from front-to-rear, again increasing the reliability with which the latches 62 extend over and retain the trigger 48 when it has been depressed to its valve actuating position.

Finally, the engagement and, preferably, the attachment of the skirt rim 32 to the chime 18 of the can 12 adds a further mechanism for resisting distortion. The can chime 18 is itself rigid, providing a secure form that maintains the shape of the skirt rim 32 when it is engaged with the chime. In the preferred embodiment, a multiplicity of vertical side braces 80 extend upwardly from the skirt rim 32 toward the level of the well floor 38, the side braces 80 projecting radially from the lower part of the peripheral skirt 30. Preferably, the side braces 80 rise from a brace floor 82 formed in the skirt 30, the brace floor preferably resting upon the can chime 18 when the actuator 10 is in place upon the can 12. The brace floor 82 preferably is substantially horizontal and in any event is less than vertical. The side braces 80 and adjacent portions of the peripheral skirt 30 effectively transmit the rigidity of the chime-stabilized skirt rim 32 to the lower portion of the bracing structure 76. The interaction of the brace floor 82 and side braces 80, in conjunction with the remaining adjacent portions of the peripheral skirt 30, also specifically strengthen the lower part of the actuator body 28 in such a manner as to resist both lateral forces and top loading applied to the actuator body 28.

It will be apparent that the side placement of the latches 62, the use of two instead of merely one latch, the bracing structure 76, well floor 38, chime-engaged skirt rim 32, and side braces 80 each individually contribute to a reliable engagement of the trigger 48 by the latches, features that are equally effective if the latches are attached to the sides of the trigger 48 and hook under or otherwise engage the well floor or other parts of the body 28 of the actuator 10. However, these individually useful parts also coact to produce a structure that is extremely structurally stable and strong, capable of withstanding a great deal of abuse or unanticipated distortive pressures. At the same time, a total release actuator 10 incorporating some or all of these features can be successfully unitarily manufactured with thin plastic walls and parts to produce an economical and lightweight total release actuator.

The method of the invention for total release of the contents of an aerosol can 10 includes the step of providing a total release actuator 10 made in accordance with the disclosure set forth, above, and attaching the total release actuator to the aerosol can, preferably with the skirt rim 32 engaging the chime 18. A subsequent step of the method is to depress the trigger 48 by manual pressure until the latch 62 engages the trigger to retain it in its valve-actuating position. Then the can 12 is left undisturbed until the can's contents are discharged.

The total release actuator of the invention may be conveniently manufactured from any suitable plastic by standard injection-molding techniques well known to those skilled in the art. All of the parts described can be unitarily molded as a single part, requiring no assembly prior to attachment to the can.

The disclosure, above, has been of a preferred embodiment. Alternative and equivalent embodiments will be apparent to those skilled in the art and lie within the breadth and scope of the present invention. Consequently, the invention should not be construed as limited to the specific forms shown and described. Instead, the invention should be understood in terms of the following claims.

Industrial Applicability

Total release actuators have application in the insect control industry as well as with any aerosol product intended to be delivered in a large, single spray. The actuator of the invention may be manufactured by conventional plastic molding techniques from conventional plastics well known to those skilled in the art.

I claim:

1. A total release actuator for use with an aerosol can having a dome and a valve having a valve stem, the actuator comprising:

a. an actuator body adapted to attach to the aerosol can and having i. a peripheral skirt extending downwardly, the lower margin of the peripheral skirt defining a skirt rim, ii. a central well having a trigger port, the trigger port having a front end, a back end, and opposed sides, b. a longitudinally extended trigger having a front end, a back end, and sides, the trigger i. being attached at one of its front and back ends to the corresponding end of the trigger port by a hinge that allows the end of the trigger that is remote from the hinge to swing downwardly when the trigger is depressed, the trigger extending from the hinge across the valve stem when the actuator is in place on the aerosol can, and ii. including a downwardly open stem socket that is adapted to receive the valve stem, the stem socket being in fluid communication with a discharge nozzle, the trigger, when moved downwardly, activating the valve by exerting pressure on the valve stem, releasing the contents of the can through the discharge nozzle via the stem socket, the actuator further including an elastically deformable latch attached to one of a side of the trigger port and a side of the trigger and adapted to engage the other of the side of the trigger port and the side of the trigger when the trigger is in a depressed, valve-activating position to retain the trigger in that position.

2. The total release actuator of claim 1 wherein the trigger is attached by the hinge at the trigger's front end to the front end of the trigger port, to allow the trigger's back end to swing downwardly when the trigger is depressed.

3. The total release actuator of claim 2 wherein the aerosol can has a chime and the skirt rim is adapted to engage the chime, the hinge is not less distal to the valve stem than the valve cup rim when the actuator is in place on the can, and the trigger includes a push pad remote from the hinge, with the stem socket being located between the hinge and the push pad.

4. The total release actuator of claim 1 including two latches, one extending from each of the opposed sides of the trigger port, to retain the trigger under and between the latches when a user has depressed the trigger downwardly beyond the latches to the valve-activating position.

5. The total release actuator of claim 1 wherein the latch extends from a side of the trigger.

6. The total release actuator of claim 1 wherein the latch extends from a side of the trigger port.

7. The total release actuator of claim 6 wherein the body includes a generally horizontal well floor and a. the trigger port extends through the well floor, b. the latch is located beneath the level of the well floor, and c. the trigger includes i. a push pad, on which a user can push to depress the trigger, and ii. a downwardly extended drop side that has an upwardly presented lug that moves beneath and then engages the latch when the trigger is depressed to the valve-activating position, the latch being located sufficiently far beneath the well floor that the trigger reaches its valve-activating position before the finger of a user, pressing on the push pad, makes contact with the latch.

8. The total release actuator of claim 1 including a tear tab unitarily molded with the trigger and the actuator body and attached by attachment members to both the end of the trigger remote from the hinge and the end of the trigger port remote from the hinge, the tear tab and attachment members being of a robustness and strength such that the tear tab stabilizes the trigger to reduce the chance of premature activation, whereas, when a user intentionally and forcibly moves the tear tab, the attachment members break, allowing the tear tab to be removed, leaving the trigger free to be depressed.

9. The total release actuator of claim 8 wherein the attachment members are shaped so as to break preferentially at a point remote from the tear tab, causing the attachment members, when the tear tab is torn away, to break free from the trigger and the trigger port and remain attached to the tear tab.

10. The total release actuator of claim 1 wherein the aerosol can has a chime, and the skirt rim attaches to the chime.

11. The total release actuator of claim 1 wherein the body includes a horizontal well floor, the peripheral skirt extends upwardly beyond the level of the well floor, and a well wall extends upwardly from the margins of the well floor and is joined to the upper margin of the peripheral skirt to form a double-walled, hollow bracing structure, the bracing structure and well floor combining to increase the resistance of the actuator body to lateral flexing.

12. A method for total release of the contents of an aerosol can having a chime and a valve, the valve having a valve stem, the method comprising the steps of:

a. attaching the total release actuator of claim 1 to the aerosol can;

b. depressing the trigger by manual pressure until the latch engages the trigger to retain it in its valve-actuating position; and c. leaving the can undisturbed until the can's contents are discharged.

13. The method of claim 12 wherein the total release actuator is the actuator of claim 2.

14. The method of claim 12 wherein the total release actuator is the actuator of claim 3.

15. The method of claim 12 wherein the total release actuator is the actuator of claim 4.

16. The method of claim 12 wherein the total release actuator is the actuator of claim 5.

17. The method of claim 12 wherein the total release actuator is the actuator of claim 6.

18. The method of claim 13 wherein the total release actuator is the actuator of claim 7.

19. The method of claim 12 wherein the total release actuator is the actuator of claim 8.

20. The method of claim 12 wherein the total release actuator is the actuator of claim 9.

21. The method of claim 12 wherein the total release actuator is the actuator of claim 10.

22. The method of claim 12 wherein the total release actuator is the actuator of claim 11.

23. A total release actuator for use with an aerosol can having a chime, a dome, and a valve having a valve stem, the actuator comprising:

a. an actuator body having i. a peripheral skirt extending downwardly to a lower margin of the peripheral skirt defining a skirt rim, the skirt rim being adapted to engage the chime of the aerosol can, ii. a central well having a generally horizontal well floor, the well floor having a trigger port extending therethrough, the trigger port having a front end, a back end, and opposed sides, b. a longitudinally extended trigger having a front end, a back end, and sides, the trigger i. being attached at one of its front and back ends to the corresponding end of the trigger port by a hinge that allows the end of the trigger that is remote from the hinge to swing downwardly when the trigger is depressed, the trigger extending from the hinge across the valve stem when the actuator is in place on the aerosol can, and ii. including a downwardly open stem socket that is adapted to receive the valve stem, the stem socket being in fluid communication with a discharge nozzle, the trigger, when moved downwardly, activating the valve by exerting pressure on the valve stem, releasing the contents of the can through the discharge nozzle via the stem socket, and c. an elastically deformable latch attached to one of a side of the trigger port and a side of the trigger and adapted to engage the other of the side of the trigger port and the side of the trigger when the trigger is in a depressed, valve-activating position to retain the trigger in that position, wherein the peripheral skirt extends upwardly above the level of the well floor, and the central well has a well wall that extends upwardly from the margins of the well floor and is joined to the upper margin of the peripheral skirt to form a double-walled, hollow bracing structure, the bracing structure, well floor, and chime-engaging skirt rim combining to increase the resistance of the actuator body to lateral flexing.

24. The total release actuator of claim 23 including two latches located on opposing sides of one of the trigger port and the trigger.

* * * * *